US012286979B2

(12) United States Patent
Tam et al.

(10) Patent No.: US 12,286,979 B2
(45) Date of Patent: Apr. 29, 2025

(54) STEAM SPECIAL EFFECT SPRAYER AND RELATED SPECIAL EFFECT SYSTEM

(71) Applicant: ITMation Ltd., Hong Kong (CN)

(72) Inventors: Eric Cheuk-Wah Tam, Hong Kong (CN); Ko Ke Hong, Hong Kong (CN)

(73) Assignee: ITMATION LTD., Hong Kong (CN)

( * ) Notice: Subject to any disclaimer, the term of this patent is extended or adjusted under 35 U.S.C. 154(b) by 516 days.

(21) Appl. No.: 17/705,855

(22) Filed: Mar. 28, 2022

(65) Prior Publication Data

US 2022/0307522 A1 Sep. 29, 2022

(30) Foreign Application Priority Data

Mar. 26, 2021 (CN) ..... 202120613899.X

(51) Int. Cl.
*F04F 5/46* (2006.01)
*F04F 5/04* (2006.01)

(52) U.S. Cl.
CPC ..... *F04F 5/461* (2013.01); *F04F 5/04* (2013.01)

(58) Field of Classification Search
CPC ..... F04F 5/461; F04F 5/04; F04F 5/467
USPC ..... 261/76, DIG. 10, DIG. 76
See application file for complete search history.

(56) References Cited

U.S. PATENT DOCUMENTS 1,137,767 A * 5/1915 Leblanc ..... F04F 5/461 417/174
1,315,931 A * 9/1919 Poppink ..... F04F 5/466 261/76
1,462,504 A * 7/1923 Frederick ..... F23D 11/10 239/431
2,190,109 A * 2/1940 Tinker ..... F04F 5/46 417/54
2,346,186 A * 4/1944 Poesl ..... D06C 7/00 261/76
2,364,199 A * 12/1944 Derr ..... F41H 9/06 417/174
5,711,481 A * 1/1998 MacDonald ..... A63J 5/025 62/52.1
8,104,745 B1 * 1/2012 Fisenko ..... F04F 5/465 261/21

(Continued)

FOREIGN PATENT DOCUMENTS

CN 106812729 A * 6/2017
CN 113101680 A * 7/2021

(Continued)

OTHER PUBLICATIONS

English Translation of EP 1870146 A2 (Year: 2007).*

(Continued)

*Primary Examiner* — Charles S Bushey
(74) *Attorney, Agent, or Firm* — ALLEN, DYER, DOPPELT + GILCHRIST, P.A.

(57) ABSTRACT

A steam special effect sprayer includes a condensation cavity, a first ejector structure, and a second ejector structure, wherein one end of the condensation cavity is connected with a steam pipeline, and the other end is connected with the second ejector structure. The first ejector structure which is built inside the condensation cavity ejects the steam from the steam pipeline into the condensation cavity, where the steam forms microdroplets, and then the second ejector structure ejects the microdroplets to the external environment.

9 Claims, 1 Drawing Sheet

(56) References Cited

U.S. PATENT DOCUMENTS 8,465,264 B2 * 6/2013 Sampson ..... B01F 23/10
454/71

FOREIGN PATENT DOCUMENTS

CN 214634022 U * 11/2021
EP 1870146 A2 * 12/2007

OTHER PUBLICATIONS

English Translation of CN 106812729 A (Year: 2017).*
English Translation of CN 113101680 A (Year: 2021).*
English Translation of CN 214634022 U (Year: 2021).*

* cited by examiner

STEAM SPECIAL EFFECT SPRAYER AND RELATED SPECIAL EFFECT SYSTEM

CROSS-REFERENCE TO RELATED APPLICATION

This application claims the benefit of Chinese Utility Model CN 202120613899, filed on Mar. 26, 2021, the contents of which are herein incorporated by reference in their entirety.

FIELD OF THE INVENTION

The present invention relates to steam effect generation equipment, and in particular, a steam special effect sprayer and a steam special effect system.

BACKGROUND OF THE INVENTION

At present, steam special effects techniques on the market generally use two technologies to achieve: the use of real steam and the use of simulated steam.

Real steam is generated by directly heating water with conventional electric or gas-type steam boilers, and then storing the production of high-temperature and high-pressure steam in a pressure vessel and releasing the steam through a pressure or flow regulating valve when needed. This method produces steam certainly with temperature and humidity, which can give the audience a very impressive scene effect. However, due to the low energy efficiency of this technology, it wastes a lot of energy, and it relies solely on the pressure of the steam itself to discharge from the special effect nozzle, so in order to increase the pressure, more energy is needed to provide the required pressure. Generally, the conventional steam special effect system needs to store steam at a pressure of about 5 kg/cm2, which means that the water temperature in the boiler and the temperature of the entire system need to be maintained at around 159 degrees Celsius, with the higher temperatures meaning higher heat loss.

Simulated steam uses a special effect smoke machine to evaporate the solution containing glycerin through a heating tube to generate a large amount of smoke to imitate steam. Because the smoke produced by the solution containing glycerin can stay in the air for a long time, a very dense steam special effect can be produced with relatively little energy. But it also has the disadvantage that it takes a relatively long time for the smoke to dissipate because the beads in the air contain oil that is not easily evaporated. In the scene of a short special effect show cycle, the smoke leftover from the previous show affects the effect of the next show. And because only a small amount of heat energy is used to produce the steam special effect, it lacks the temperature of real steam, and cannot meet the special effect requirements of certain themes. Also, the smoke produced will have the sweet taste of glycerin, which will affect the audience's experience of special effects, give rise to health risks after long-term inhalation, and also pollute the show scene.

SUMMARY OF THE INVENTION

Aiming at the problems existing in the prior art, this invention provides a steam special effect sprayer and a steam special effect system. In order to achieve the above purposes, the present invention is realized by the following technical scheme:

A steam special effect sprayer comprises a condensation cavity, a first ejector structure, and a second ejector structure, wherein one end of the condensation cavity is connected with a steam pipeline, and the other end is connected with the second ejector structure. The first ejector structure which is built inside the condensation cavity ejects the steam from the steam pipeline into the condensation cavity, where the steam forms microdroplets, and then the second ejector structure ejects the microdroplets to the external environment.

Furthermore, the first ejector structure is an air jet nozzle, which comprises a nozzle, an air inlet end, and an air outlet end, wherein the nozzle is arranged in the condensation cavity, and the air inlet end is connected with the external air supply device, and the air outlet end faces the second ejector structure.

Furthermore, the nozzle itself is a linear cavity or a curved cavity with a certain length.

Furthermore, the second ejector structure comprises a nozzle, which is a cavity with an air outlet at its front end and an air inlet at its rear end, and the air inlet is connected with the condensation cavity, and the air outlet is a spray outlet, and a Venturi tube is set in the nozzle, with its inlet end and outlet end facing the nozzle's air inlet and air outlet respectively.

Furthermore, the rear end of the nozzle is also provided with suction holes.

Furthermore, it also includes a direction-changing tube, which comprises a connecting part and a direction-changing part, wherein the connecting part and the direction-changing part are connected, and the end of the connecting part is connected with the nozzle, and the end of the direction-changing part is a free end, and this free end is a fog outlet end.

Furthermore, the angle between the connecting part and direction-changing part will be $-90° < \alpha < 90°$.

Furthermore, the ratio of the inner diameters of the condensation cavity, the air jet nozzle, and the throat of the Venturi tube is 1:0.16:3.

Furthermore, it includes a steam pipeline and an air supply pipeline, wherein one end of the steam pipeline is connected with a steam generator, while the other end is connected with the first ejector structure, and the steam pipeline is equipped with a safety valve, a drain valve, and a steam flow control valve and one end of the air supply pipeline is connected to the air source, while the other end is connected to the first ejector structure, and the air supply pipeline is equipped with a pressure regulator and an airflow control valve. The present invention has the advantages that:

1. The fog spayed by this steam special effect sprayer provided by the present invention is a mixture of steam and compressed gas, and a snow-white dense fog can be made with only a small amount of steam, so it is more energy-saving and less emission. And the temperature of the sprayed fog temperature drops to a safe range so that it is safer and reliable.
2. The first and second ejector structures enable twice liquefaction and twice ejection of steam located in the steam pipe, as well as the push and ejection of microdroplets located in the condensation chamber, and the increase in the volume of microdroplets located in the second ejector structure, therefore rapid fogging can be achieved, which can create a large amount of fog in a short time to meet the user requirements.

3. At the same steam output flow, different visual effects can be achieved by controlling the mixture ratio of compressed air and steam to change the color and saturation of steam.
4. The steam output effect can be maintained the same in different ambient temperatures and humidity or different seasons by adjusting the amount of compressed air.

DETAILED DESCRIPTION OF PREFERRED EMBODIMENTS

Figure 1:
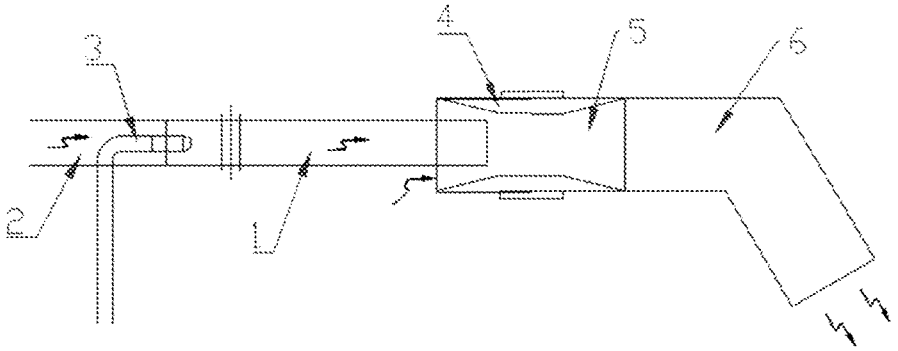
FIG. 1 is a structural diagram of the steam special effect sprayer of the present invention.

Next, the technical scheme in the embodiment of the present invention will be clearly and completely described regarding the drawings in the embodiment of the present invention.

In the description of this application, it should be noted that the orientation or positional relationship indicated by the terms "center", "up", "down", "left", "right", "vertical", "horizontal", "inside", "outside" is based on the orientation or positional relationship shown in the drawings, for the convenience of the describing this application and simplifying the description only, and it does not indicate or imply that the device or component referred to must have a specific orientation, be constructed and operated in a specific orientation, therefore it cannot be construed as a limitation of this application. In addition, the terms "first", "second" and "third" are used only for descriptive purposes only, which shall not be understood as indicating or implying relative importance.

Unless expressly specified and limited otherwise, the terms "installation", "connected" and "connection" should be understood broadly, for example, it could be a fixed connection, a detachable connection, or an integrated connection; could be mechanically connected, or electrically connected; could be directly connected or indirectly connected through an intermediate medium; and could be the internal connection of two elements. For one of the ordinary skill in the art, the specific meanings of the above terms in this application can be understood in specific situations.

FIG. 1 is a structural diagram of a steam special effect sprayer provided by the present invention, and a steam special effect sprayer comprises a condensation cavity 1, a first ejector structure, and a second ejector structure. One end of the condensing cavity 1 is connected to the steam pipeline 2, while the other end is connected with the second ejector structure, and the first ejector structure is arranged in the condensation cavity 1.

The first ejector structure reduces the temperature of steam in the condensation cavity 1, to liquefy it into microdroplets, and pushes the microdroplets to rush out of the condensation cavity 1 at the same time, causing negative pressure in the condensation cavity 1, which ejects the steam in the steam pipeline 2. The microdroplets rushed out of the condensation cavity 1 enter into the second ejector structure, and are expanded in volume, and then ejected to the external environment by the effect of the second ejector structure.

Specifically, the condensation cavity 1 is a cavity with an air inlet and an air outlet, and the shape of the condensation cavity 1 is not limited, therefore any shape of a cavity can be used. For example, cuboid, cube, cylinder, prism can be used.

The condensation cavity 1 is connected with the steam pipeline 2, and the steam in the steam pipeline 2 can spontaneously enter the condensation cavity 1, however, its moving speed is very slow in the steam pipeline 2 and the amount of fog discharged into the environment is too small to meet the user requirement, if only by the pressure of steam itself. Usually, it requires to consume a lot of energy at the steam supply end to improve the speed of steam generation, thereby a large amount of energy is wasted.

The first ejector structure has the functions of both condensation and ejection, that is, the steam in the condensation cavity 1 is cooled to be liquefied into microdroplets while driving the microdroplets to rush out from the condensation cavity 1, and the negative pressure of condensation cavity 1 ejects the steam in the steam pipeline 2, which accelerates its flow rate.

The first ejector structure is an air jet nozzle 3, which comprises a nozzle, an air inlet end, and an air outlet end. The nozzle itself is a linear cavity or a curved cavity with a certain length, and the air inlet and outlet ends are located at both ends of the bar cavity or arc cavity respectively. The nozzle is arranged in the condensation cavity, and the air inlet end is connected with the external air supply device, and the air outlet end faces the second ejector structure. The connection between the air jet nozzle 3 and the condensation cavity 1 is a detachable connection, which is convenient for replacement.

The air supply provides compressed air to air jet nozzle 3, and the temperature and pressure of the compressed air can be adjusted according to the amount of fog to be generated and the surrounding environment, but the temperature of compressed air should be lower than the temperature of the steam so that the steam can be atomized.

The compressed air jetted from the air jet nozzle 3 has a rapid flow rate, so it generates turbulence, which can make the compressed air and steam fully mixed, and improve the conversion rate of steam to microdroplets, and it pushes the microdroplets in front of the condensation cavity 1 to move rapidly to enter the second pilot structure at a fast speed, and at the rear end of the air jet nozzle 3, negative pressure is generated ejecting new steam into the condensation cavity 1.

In short, the air turbulence makes the steam quickly and fully atomize into microdroplets, and drives the microdroplets to move quickly, so that in a short period, it can produce a large amount of fog, which has high density, high visibility, and brings a stunning visual effect to the external environment just like a wonderland.

The second ejector structure receives the microdroplets with a higher flow rate from the condensation cavity 1, and further condenses the microdroplets, to fully liquefy the steam mixed therein, and further increases the volume and flow rate of the microdroplets, to allow them to erupt rapidly into the external environment, and the microdroplets expand, which can further increase the amount of fog.

The second ejector structure comprises a nozzle 4, a Venturi tube 5, and a direction-changing tube 6.

Nozzle 4 is a cavity with an air outlet at its front end and an air inlet at its rear end, and the air inlet is connected with the condensation cavity 1, and the air outlet is a spray outlet to spray fog to the external environment, and the rear end of this cavity is also provided with several air suction holes.

A Venturi tube 5 is set in the nozzle, with its inlet end and outlet end facing the nozzle's air inlet and air outlet respectively. The shape and construction of the Venturi tube 5 can be any shape and structure in the prior art, as long as it has the function of generating a negative pressure, therefore, the simple modification and replacement of Venturi tube 5 are also included in the protection scope of this application.

The microdroplets ejected from the condensation cavity 1 enter nozzle 4, while the Venturi tube 5 located in nozzle 4 increases the flow rate of the microdroplets therein to produce a negative pressure effect, which not only ejects the microdroplets in the condensation cavity 1, and accelerates the flow rate of the microdroplets, but also further strengthens the negative pressure in the condensation cavity 1, and makes the air in the external environment enter the nozzle 4 through the suction holes of the nozzle 4 with the effect of negative pressure, and the air entering the nozzle 4 is mixed with the microdroplets in the nozzle 4, and the microdroplets are liquefied for a second time, so that the steam mixed therein is fully liquefied into microdroplets, increasing the volume of fog, therefore the nozzle 4 can discharge a large number of dense white fog, resulting in excellent visual effect in a short period.

It should be noted that the fog itself ejected from the condensation cavity 1 has a higher flow rate due to the acceleration of the first ejector structure, so after entering the Venturi tube 5, the negative pressure effect of Venturi tube 5 is enhanced, making the Venturi tube 5 have a better negative pressure effect.

The direction-changing tube 6 comprises a connecting part and a direction-changing part, wherein the connecting part and the direction-changing part are connected, and the end of the connecting part is connected with the nozzle, and the end of the direction-changing part is a free end, from which the produced fog is sprayed to the external environment. The fog spraying direction can be adjusted by changing the orientation of the free end as required. The angle between the connecting part and direction-changing part will be $-90° < \alpha < 90°$. The ratio of the inner diameters of the condensation cavity 1, the air jet nozzle 3, and the throat of the Venturi tube 5 is 1:0.16:3.

In summary, the first ejector structure pushes the flow of steam in condensing cavity 1 and creates negative pressure to eject the steam in the steam pipeline 2 at an accelerated speed, while the second ejector structure uses the first acceleration by the first ejector structure to achieve a second acceleration of the gas. With the first acceleration, the steam condenses into microdroplets, and with the second acceleration, the microdroplets expand in volume, and the two effects interact, which not only improve the speed of fog but also create a denser white fog, making visual effects more real and shocking.

Figure 2:
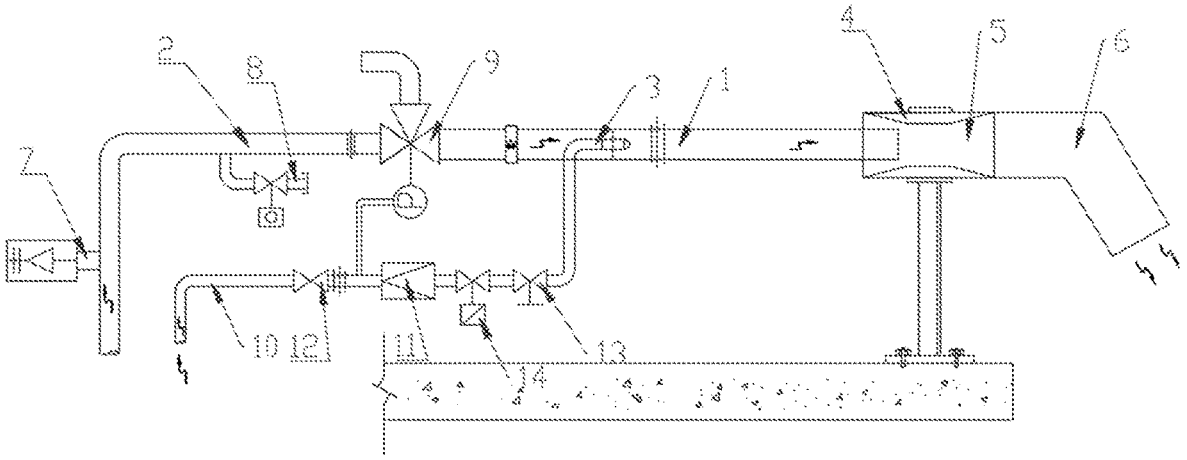
FIG. 2 is a structural diagram of the steam special effect system of the present invention.

Referring to FIG. 2, the steam effect system comprises a steam pipeline 2, wherein one end of the steam pipeline is connected with the steam generator, while the other end is connected with the condensation cavity 1. Steam pipeline 2 is provided with a safety valve 7, a drain valve 8, and a steam volume control valve 9.

The steam effect system also comprises an air supply pipeline 10, wherein one end of the air supply pipeline 10 is connected with an air source, while the other end is connected with the first ejector structure. The air source is a device or equipment to produce compressed air. The air supply pipeline 10 is equipped with a pressure regulator 11 and an air volume control valve, which comprises a ball valve 12, a needle valve 13, and an air solenoid valve 14.

Working principle: the first ejector structure pushes the microdroplets group inside it to move quickly, and the negative pressure generated in the condensation cavity 1 ejects the steam in the steam pipeline 2. The microdroplets group is ejected from the condensation cavity 1 and enters the second ejector structure, and again, due to the negative pressure, it is ejected from the second ejector structure for a second time at a very high speed. The first ejector structure atomizes steam into high-density microdroplets group, and then with the effect of the second ejector structure, the high-density microdroplets group expands in volume. Therefore, the steam special effect sprayer and the steam special effect system provided by the present invention can provide sufficient fog for users in a short period and are more energy-saving and environment-friendly, compared with the prior art.

The above content is a further detailed description of the present invention combined with the specific preferred embodiments, and it cannot be considered that the specific implementation of the present invention is only limited to these descriptions. For one of the ordinary skill in the art to which the present invention belongs, several simple deductions or substitutions can be made without departing from the concept of the present invention, which shall be also regarded as falling within the scope of protection of the present invention.

REFERENCE NUMBERS

1—condensation cavity
2—steam pipeline
3—air jet nozzle
4—nozzle
5—Venturi tube
6—direction-changing tube
7—safety valve
8—drain valve
9—steam flow control valve
10—air supply pipeline
11—air pressure regulator
12—ball valve
13—needle valve
14—solenoid valve

What is claimed is:

1. A steam special effect sprayer comprising:
a condensation cavity;
a first ejector structure;
a second ejector structure;
wherein one end of the condensation cavity is connected with a steam pipe and the other end is connected with the second ejector structure;
wherein the first ejector structure is built inside the condensation cavity and is configured to eject the steam from the steam pipe into the condensation cavity to form microdroplets; and
wherein the second ejector structure is configured to eject the microdroplets to an external environment.

2. The steam special effect sprayer of claim 1, wherein the first ejector structure includes an air jet nozzle having a first nozzle, a first air inlet end, and a first air outlet end; and
wherein the first nozzle is arranged in the condensation cavity, the first air inlet end is connected with an external air supply device, and the first air outlet end faces the second ejector structure.

3. The steam special effect sprayer of claim 2, wherein the first nozzle is a linear cavity or a curved cavity with a certain length.

4. The steam special effect sprayer of claim 3, wherein the second ejector structure comprises a second nozzle, which is a cavity with a second air outlet at its front end and a second air inlet at its rear end; and wherein the second air inlet is connected with the condensation cavity, and the second air outlet is a spray outlet, and a Venturi tube is set in the second nozzle, with inlet and outlet ends of the Venturi tube facing the second air inlet and outlets of the second nozzle, respectively.

5. The steam special effect sprayer of claim 4, wherein the rear end of the second nozzle is also provided with a suction hole.

6. The steam special effect sprayer of claim 4, further comprising a direction-changing tube having a connecting part and a direction-changing part;

wherein the connecting part and the direction-changing part are connected, and the end of the connecting part is connected with the second nozzle, and the end of the direction-changing part is a free end, and this free end is a fog outlet end.

7. The steam special effect sprayer of claim 6, wherein the angle between the connecting part and direction-changing part is $-90° < \alpha < 90°$.

8. The steam special effect sprayer of claim 4, wherein the ratio of the inner diameters of the condensation cavity, the air jet nozzle, and the throat of the Venturi tube is 1:0.16:3.

9. A steam special effect system comprising:

a steam pipeline;

an air supply pipeline;

wherein one end of the steam pipeline is connected with a steam generator and the other end is connected with a first ejector structure;

wherein the steam pipeline is equipped with a safety valve, a drain valve, and a steam flow control valve; and wherein one end of the air supply pipeline is connected to an air source and the other end is connected to the first ejector structure, and the air supply pipeline is equipped with a pressure regulator and an airflow control valve.

* * * * *